United States Patent [19]

Barrett

[11] Patent Number: 4,738,367

[45] Date of Patent: Apr. 19, 1988

[54] MAGNETIC REFUSE SEPARATOR

[75] Inventor: William T. Barrett, Waukesha, Wis.

[73] Assignee: Venturedyne, Ltd., Milwaukee, Wis.

[21] Appl. No.: 901,294

[22] Filed: Aug. 28, 1986

Related U.S. Application Data

[63] Continuation-in-part of Ser. No. 768,918, Aug. 23, 1985, abandoned, which is a continuation of Ser. No. 582,319, Feb. 22, 1984, abandoned.

[51] Int. Cl.[4] ..... B07C 5/34

[52] U.S. Cl. ..... 209/223.1; 209/226; 209/930

[58] Field of Search ..... 209/930, 223.1, 215, 209/224, 226, 223.2; 198/461

[56] References Cited

U.S. PATENT DOCUMENTS

| | | | |
|---|---|---|---|
| 2,702,123 | 2/1955 | Injeski, Jr. | 209/223.1 |
| 3,323,633 | 6/1967 | Engle et al. | 198/461 X |
| 3,809,239 | 5/1974 | Barrett et al. | 209/223.1 X |
| 3,935,947 | 2/1976 | Barrett | 209/930 X |
| 4,031,004 | 6/1977 | Sommer, Jr. et al. | 209/212 |
| 4,055,489 | 10/1977 | Soley | 209/223.1 |
| 4,125,191 | 11/1978 | Peace | 209/215 X |
| 4,686,034 | 8/1987 | Barrett | 209/930 X |

FOREIGN PATENT DOCUMENTS

| | | | |
|---|---|---|---|
| 75619 | 9/1949 | Norway | 209/223.1 |

*Primary Examiner*—Robert B. Reeves
*Assistant Examiner*—Russell D. Stormer
*Attorney, Agent, or Firm*—Michael, Best & Friedrich

[57] ABSTRACT

A magnetic separator comprising a plurality of relatively aligned magnetic field generators and a belt associated with the magnetic field generators and supported to move serially through the magnetic fields generated by the magnetic field generators. The magnetic field generators are spaced relative to each other in the direction of their relative alignment a distance sufficient to produce serial gaps between the magnetic fields generated such that magnetic articles attracted to the belt by one of the magnetic fields fall away from the belt at the gaps. The magnetic separator also comprises a conveyor below the belt and supported at the gaps to receive magnetic articles falling from one of the magnetic fields and to transport the fallen magnetic articles to the next magnetic field where the magnetic articles are again attracted to the belt.

23 Claims, 2 Drawing Sheets

MAGNETIC REFUSE SEPARATOR

RELATED APPLICATIONS

This is a continuation-in-part of copending application Ser. No. 768,918, filed Aug. 23, 1985 and now abandoned, which is a continuation of application Ser. No. 582,319, filed Feb. 22, 1984 and now abandoned.

BACKGROUND OF THE INVENTION

This invention relates to magnetic separators and, more particularly, to magnetic separation of magnetic material in refuse.

With more and more emphasis being placed on recycling, it is becoming more desirable to recover salvageable articles from otherwise discarded material. Much of the metalic material discarded as refuse can generally be recycled for one purpose or another, provided it can be efficiently separated from the remainder of the refuse. The metalic material intended to be recaptured is generally also magnetic so that magnetic separation is a possibility for recapture. However, the nonmetalic material, e.g., paper, is usually light and tangled with the magnetic material and thus subject to being carried along with the magnetic material, making complete separation difficult, if not impossible. Also, in some cases it may be desirable to separate the lighter material (e.g. paper) for recycling.

There are various designs of magnetic separators, none of which, to the inventor's knowledge, insure complete separation of magnetic material from nonmagnetic material.

One type of magnetic separator provides a continuous belt moving through a magnetic field generated by a magnetic assembly, the magnetic assembly being positioned above a portion of the belt. The magnetic assembly typically comprises a plurality of magnets magnetically coupled together. Magnetic objects are attracted to and carried along the belt, while nonmagnetic objects fall away from the belt and are thereby separated from the magnetic objects. A problem with this type of magnetic separator is that heavy magnetic objects sometimes fall away from the belt as they are transferred from one magnet of the magnetic assembly to another, and are irretrievably lost.

Barrett, et al., U.S. Pat. Nos. 3,890,239 and 3,935,947, both entitled "Magnetic Refuse Separator," disclose magnetic separators.

SUMMARY OF THE INVENTION

The invention provides a magnetic separator comprising first belt means, means supporting the first belt means for movement along a horizontal path and with a portion of the first belt means facing downwardly, and means for moving the first belt means along the horizontal path. Preferably, the first belt means is a conveyor belt moving around a closed path, with a portion of the closed path being horizontal.

The magnetic separator also comprises magnetic field generating means supported adjacent the first belt means along the horizontal path to generate an attractive magnetic field through which the first belt means moves. The magnetic field generating means includes first and second magnetic field generating portions, the second field generating portion being spaced horizontally a predetermined distance from the first field generating portion in the direction of movement of the first belt means along the horizontal path. This provides a gap in the magnetic field generated by the magnetic field generating means so that magnetic articles attracted to the first belt means in the area of the first field generating portion are released in the gap and fall away from the first belt means. In the preferred embodiment, the magnetic field generating portions are conventional electromagnets.

The magnetic separator further comprises second belt means and means supporting the second belt means for movement along a horizontal path and with a portion of the second belt means facing generally upwardly. The second belt means is positioned generally between the first magnetic field generating portion and the second magnetic field generating portion so that articles released in the gap and falling away from the first belt means fall onto the second belt means.

The magnetic separator further comprises means for moving the second belt means along the horizontal path and into the attractive magnetic field generated by the second magnetic field generating portion so that magnetic articles that have fallen onto the second belt means from the first belt means at the gap are conveyed by the second belt means along the horizontal path to the magnetic field of the second magnetic field generating portion. At this point, the magnetic articles are again attracted to the first belt means, this time in the area of the second magnetic field generating portion, while nonmagnetic articles carried with the magnetic articles remain on the second belt means and are thus separated from the magnetic articles.

In the preferred embodiment, the second belt means is also a conveyor belt moving around a closed path, with a portion of the closed path being horizontal.

In the preferred embodiment, burden is supplied to the magnetic separator by a supply conveyor having a discharge end located adjacent the first belt means and the first magnetic field generating portion so that magnetic articles on the supply conveyor are attracted to the first belt means by the first magnetic field generating portion. In order to prevent rod-like pieces of magnetic material from becoming jammed between the first belt means and the supply conveyor when being transferred from the supply conveyor to the first belt means, or between the second belt means and the first belt means when being transferred from the second belt means to the first belt means, the first belt means moves at a speed which is greater than both the speed of the supply conveyor and the speed of the second belt means.

A principal advantage of the invention is that it provides an improved means for separating magnetic articles from nonmagnetic articles, this being picking up, dropping and again picking up of the magnetic articles.

Another advantage of the invention is that magnetic articles need not be conveyed continuously by a single belt from the magnetic field of one magnet to the magnetic field of another.

Another advantage of the invention is that the first belt means moves faster than the second belt means in order to prevent jamming of rod-like articles.

Other advantages of the invention will become apparent to those skilled in the art upon review of the following detailed description, claims and drawings.

DESCRIPTION OF THE PREFERRED EMBODIMENT

Figure 2:
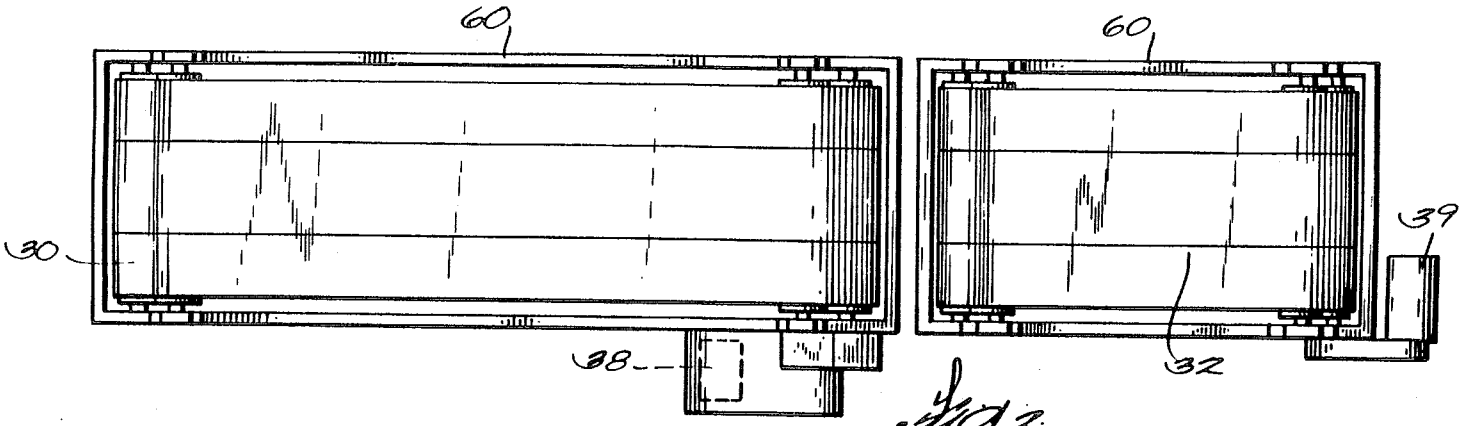
FIG. 2 is a top view of the refuse separator of FIG. 1.

Illustrated in the drawings is a magnetic refuse separator 10 in combination with a supply conveyor 12, a hopper 14, and a splitter baffle 16. The function of the hopper 14 and splitter baffle 16 is to physically segregate separated magnetic and nonmagnetic material. No particular form of either is necessary.

The refuse separator 10 is intended to receive burden from the supply conveyor 12 and carry the magnetic portion of the burden over the splitter baffle 16 while the nonmagnetic portion falls, by reason of gravity into the hopper 14. To this end, the separator 10 includes a plurality of relatively aligned magnetic field generating portions 18 and first conveying means 20 supported to move serially through the magnetic field generated by the magnetic field generating portions 18. The magnetic field generating portions 18 are spaced relative to each other in the direction of their relative alignment a distance sufficient to produce serial gaps between the magnetic fields generated such that magnetic articles attracted to the first conveying means 20 by one of the magnetic fields fall away from the first conveying means 20 at the gaps. The separator 10 further includes second conveying means 22 below the first conveying means 20 and supported at the gaps to receive magnetic articles falling from one of the magnetic fields and to transport the fallen magnetic articles to the next magnetic field where they are again attracted to the first conveying means 20.

While various suitable first conveying means 20 could be employed, in the preferred embodiment, the first conveying means 20 comprises a pair of conveyor belts 30 and 32, each of which moves around a closed path and in the illustrated construction, in a counter-clockwise manner. Belt 30 moves around pulleys or rollers 34 and 36 and has a generally horizontal lower extension. The drive pulley 34 is connected to a drive motor 38 through a drive belt 40 so that belt 30 is driven by the drive pulley 34. Thus, belt 30 travels in a continuous closed path under the influence of the drive pulley 34.

Belt 32 also moves around pulleys or rollers 35 and 37 and has a generally horizontal lower extension. The drive pulley 35 is connected to a drive motor 39 through a drive belt so that belt 32 is driven by the drive pulley 35.

In the preferred embodiment, the magnetic field generating portions 18 are conventional electromagnets 42, 44 and 46. The magnets are spaced apart a sufficient distance so that the magnetic flux in the gap between the magnets is either reduced to zero or diminished to a point where magnetic articles are not attracted.

It should be appreciated that the magnetic field generating portions 18 could also be permanent magnets or a combination of electromagnets and permanent magnets. Electromagnets afford a possible safety advantage when work must be done in the area of the separator in that they can be turned off and cleared of all material.

While other suitable means could be used, in the preferred embodiment the second conveying means 22 comprises conveyor belts 48 and 50 positioned generally between the magnets 42, 44, and 46. Each belt moves continuously around a pair of rollers 52, with one of the rollers 52 being driven by a drive motor (not shown) in a manner similar to that in which the drive motor 38 drives belt 30. Each belt has a generally horizontal upper extension. In the illustrated construction, belts 48 and 50 move in a clockwise manner so that the upper extensions of belts 48 and 50 are moving in the same direction as the lower extensions of belts 30 and 32.

Belts 48 and 50 are positioned generally between magnets 42, 44, and 46 such that articles released in one of the gaps and falling away from one of belts 30 and 32 fall onto one of belts 48 and 50 and are conveyed by the belt to the magnetic field of the next magnet. At this point, the magnetic articles are again attracted to belt 30 or 32 adjacent the next magnet, whereby nonmagnetic articles carried with the magnetic articles are separated therefrom.

Figure 1:
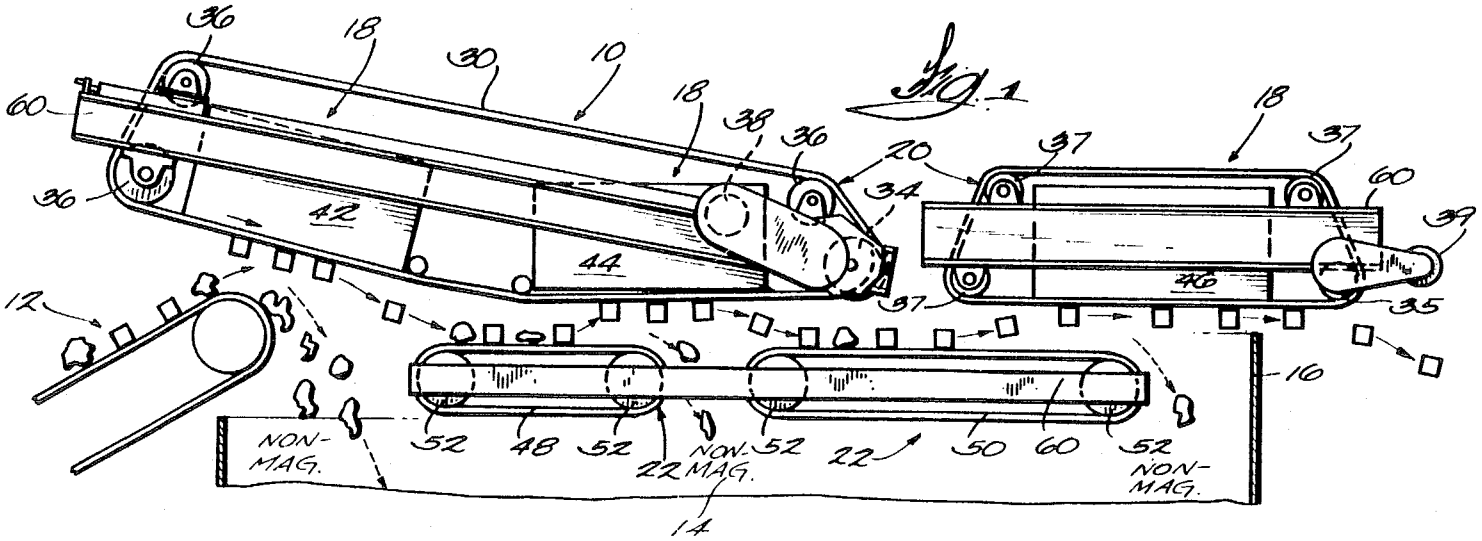
FIG. 1 is a side view of a combination refuse separator and supply conveyor.

The belts and magnets may be supported by any suitable frame structure, and a portion of a frame structure 60 is illustrated in FIG. 1. A complete showing of the strucural framework of the separator 10 is not necessary to an understanding of this invention, and a general description of the support structure is believed to be adequate. Also, the upper belts 30 and 32 should be adjustable vertically with respect to the supply conveyor 12 and the lower belts 48 and 50, or vice versa, and the lower belts 48 and 50 should be adjustable horizontally with respect to the upper belts 30 and 32, or vice versa. The details of an adjustable mounting are not shown, but if details of such a mounting are desired, reference may be had to the aforementioned U.S. Pat. No. 3,809,239 Barrett.

In operation, as shown in FIG. 1, the conveyor 12 carries burden into the magnetic field of magnet 42 and the magnetic material contained in the burden is attracted to belt 30 by magnet 42. The nonmagnetic material such as paper will fall by gravity into the hopper 14, and the magnetic material travels with belt 30. However, paper and like nonmagnetic material, being relatively light, is prone to being tangled with the magnetic material and carried along with it into engagement with belt 30 such that it cannot fall into the hopper 14. To provide improved means for dislodging this entrapped nonmagnetic material, this invention provides for dropping and picking up of the burden carried by belt 30.

More specifically, a magnetic article is initially attracted to belt 30 by magnet 42. The magnetic article is then conveyed through the magnetic field of magnet 42 (to the right in FIG. 1) until it reaches the gap between magnets 42 and 44. Since there is no attractive force in the gap holding the magnetic article on belt 30, the magnetic article will fall, due to gravity, onto belt 48. During the course of tumbling through the air and landing on belt 48, any nonmagnetic articles that were entangled with the magnetic article should become separated therefrom.

Belt 48 then conveys the magnetic article and any nonmagnetic articles that have fallen thereon into the magnetic field of magnet 44. Here the magnetic article is again attracted to belt 30, while any nonmagnetic articles that were carried to belt 48 with the magnetic article will remain on belt 48 until they fall from the end of the upper extension of belt 48 into the hopper 14.

After being again attracted to belt 30, the magnetic article is conveyed by belt 30 through the magnetic field of magnet 44. Upon reaching the gap between magnets 44 and 46, the magnetic article again falls away from belt 30, this time onto belt 50, and the process of separating nonmagnetic articles from the magnetic article is repeated. Any nonmagnetic articles that were carried by the magnetic article to belt 50 are deposited into the hopper 14 at the end of the upper extension of belt 50, while the magnetic article is attracted to belt 32 in the magnetic field of magnet 46, Belt 32 conveys the magnetic article through the magnetic field of magnet 46 and over the splitter baffle 16, where the magnetic article is then dropped from the separator 10 into an area separated from the hopper 14.

Preferably, in order to prevent rod-like magnetic articles from becoming jammed between the belt 30 and the belt 48 when being transferred from the belt 48 to the belt 30, or between the belt 32 and the belt 50 when being transferred from the belt 50 to the belt 32, the belts 30 and 32 move faster than the belts 48 and 50. For the same reason, the belt 30 moves faster than the supply conveyor 12. In the preferred embodiment, the belts 30 and 32 move at least 50 feet per minute faster than the belts 48 and 50. An example of suitable speeds is 350 feet per minute for the belts 30 and 32 and 300 feet per minute for the supply conveyor 12 and the belts 48 and 50.

It has been determined that the magnets pick up rod-like articles one end at a time. When the upper or leading end of a rod-like article engages one of the upper belts 30 and 32, it will move forwardly (to the right in FIG. 1) faster than the lower or trailing end of the article, because of the greater speed of the upper belt. As a result, the article will tip or rotate in the clockwise direction (as viewed in FIG. 1) rather than standing on end and becoming jammed between the upper and lower belts.

While the logical assumption would be that rod-like articles could also become jammed when being dropped from an upstream upper belt to a downstream lower belt (e.g., from the belt 30 to the belt 48 or from the belt 30 to the belt 50), and that it would therefore be necessary to have a downstream lower belt move faster than an upstream upper belt (e.g., have the belt 50 move faster than the belt 30), it has been determined that this is not the case.

While the magnets pick up rod-like articles one end at a time, it has been found that the magnets drop rod-like articles both ends at once, i.e., the leading end does not fall onto the lower belt before the trailing end does. Therefore, rod-like articles will not become jammed between an upstream upper belt and a downstream lower belt even if the downstream lower belt moves more slowly than the upstream upper belt. Thus, the belt 48 can move more slowly than the belt 30 even though articles are dropped from the belt 30 onto the belt 48. Furthermore, it is possible to run both of the upper belts 30 and 32 at one speed (350 fpm) and both of the lower belts 48 and 50 at another slower speed (300 fpm)

An additional advantage of this invention, along with improved separation of magnetic and nonmagnetic articles, is that magnetic articles need not be conveyed continuously by a single belt from the magnetic field of one magnet to the mangetic field of another. This is sometimes a problem in that heavy magnetic objects tend to fall off as they are transferred from one magnet to another. This invention does not attempt to do this as each magnet picks up and drops the magnetic articles.

Figure 3:
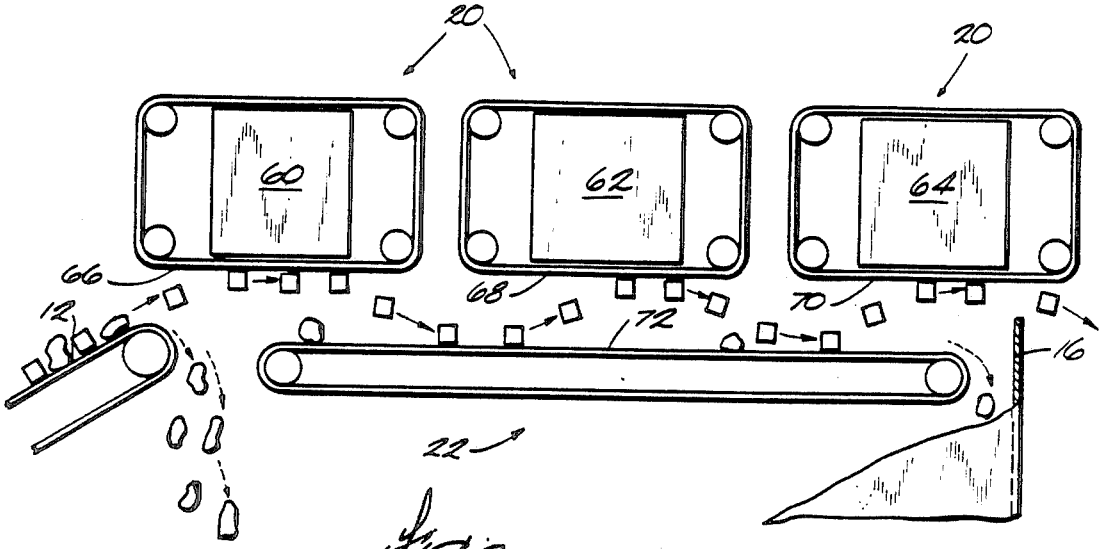
FIG. 3 is a schematic view of an alternative embodiment of the refuse separator.

Illustrated in FIG. 3 is an alternative embodiment of the invention. The magnetic field generating portions are magnets 60, 62, and 64. The first conveying means 20 comprises three separate belts 66, 68, and 70 with belt 66 moving along a continuous path around magnet 60, belt 68 moving along a continuous path around magnet 62, and belt 70 moving along a continuous path around magnet 64. The second conveying means 22 comprises a single belt 72 extending from beneath magnet 60 to beneath magnet 64, and moving along a continous path having a generally horizontal upper extension.

In the construction illustrated in FIG. 3, belts 66, 68, and 70 move counter-clockwise, and belt 72 moves clockwise.

In operation, the conveyor 12 carries burden into the magnetic field of magnet 60 and the magnetic material contained in the burden is thereby attracted to belt 66. The magnetic material is then carried by belt 66 to the gap between magnets 60 and 62, where it is dropped onto belt 72, whereby it is carried into the magnetic field of magnet 62 where it is attracted to belt 68. The magnetic material is next carried by belt 68 to the gap between magnets 62 and 64, where it is dropped again onto belt 72, whereby it is carried into the magnetic field of magnet 64, where it is attracted to belt 70. The magnetic material is finally carried by belt 70 over the splitter baffle 16, where it is dropped in an area separated from nonmagnetic material. Meanwhile, nonmagnetic material carried with the magnetic material to belt 72 is deposited from the end of belt 72 on the side of the splitter baffle 16 opposite the side on which magnetic material is deposited.

Preferably, in the alternative embodiment shown in FIG. 3, the conveyor 12 and belt 72 move at 300 feet per minute, and the belts 66, 68 and 70 move at 350 feet per minute.

It should be appreciated that many other combinations of magnets and conveying means are within the scope of the invention, and that the conveying means need not be conveyor belts. Any means conveying the magnetic material through the magnetic fields will do. Furthermore, the invention does not reguire more than two magnetic field generating portions, or, alternatively stated, more than one gap. Depending on the nature of the refuse to be separated, one gap may be sufficient. Additional gaps, or additional dropping and picking up of magnetic material, simply increase the likelihood of complete separation of magnetic and nonmagnetic material.

I claim:

1. A magnetic refuse separator comprising first belt means, means supporting said first belt means for movement along a first horizontal path, means for moving said first belt means along said first horizontal path, stationary magnetic field generating means supported adjacent and above said first belt means along said first horizontal path to generate a stationary, attractive magnetic field through which said first belt means moves, said magnetic field generating means including a first stationary magnetic field generating portion and a second stationary magnetic field generating portion, said second field generating portion being spaced horizontally a predetermined distance from said first field generating portion in the direction of movement of said first belt means along said first horizontal path to provide a gap in the magnetic field generated by said magnetic field generating means so that magnetic articles attracted to said first belt means in the area of said first field generating portion are released in said gap and fall away from said first belt means, second belt means, means supporting said second belt means for movement along a second horizontal path and with a portion of said second belt means facing generally upwardly and being positioned generally between said first magnetic field generating portion and said second magnetic field generating portion so that articles released in said gap and falling away from said first belt means fall onto said second belt means, and means for moving said second belt means along said second horizontal path and into the attractive magnetic field generated by said second magnetic field generating portion so that magnetic articles falling from said first belt means at said gap are conveyed by said second belt means along said second horizontal path to the magnetic field of said second magnetic field generating portion and are again attracted to said first belt means in the area of said second field generating portion, whereby nonmagnetic articles carried with said magnetic articles are separated therefrom.

2. The magnetic refuse separator of claim 1 wherein said magnetic field generating means further includes a third stationary magnetic field generating portion spaced horizontally a predetermined distance from said second field generating portion in the direction of movement of said first belt means along said first horizontal path to provide a second gap in the magnetic field generated by said magnetic field generating means so that magnetic articles attracted to said first belt means in the area of said second field generating portion are released in said second gap and fall away from said first belt means, and wherein said magnetic refuse separator further comprises third belt means, means supporting said third belt means for movement along a third horizontal path and with a portion of said third belt means facing generally upwardly and being positioned generally between said second magnetic field generating portion and said third magnetic field generating portion so that magnetic articles released in said second gap and falling away from said first belt means fall onto said third belt means, and means for moving said third belt means along said third horizontal path and into the attractive magnetic field generated by said third magnetic field generating portion so that magnetic articles falling from said first belt means at said second gap are conveyed by said third belt means along said third horizontal path to the magnetic field of said third magnetic field generating portion and are again attracted to said first belt means in the area of said third field generating portion, whereby nonmagnetic articles carried with said magnetic articles are separated therefrom.

3. A magnetic refuse separator as set forth in claim 1 wherein said first belt means moves along said first path faster than said second belt means moves along said second path.

4. A magnetic refuse separator as set forth in claim 3 wherein the speed of said first belt means is at least 50 feet per minute greater than the speed of said second belt means.

5. A magnetic refuse separator as set forth in claim 4 wherein said first belt means moves along said first path at a speed of approximately 350 feet per minute, and wherein said second belt means moves along said second path at a speed of approximately 300 feet per minute.

6. A magnetic refuse separator comprising a plurality of relatively aligned, stationary magnetic field generating means for generating stationary magnetic fields, first belt means associated with said magnetic field generating means and supported to move serially beneath said magnetic field generating means through the magnetic fields generated by said magnetic field generating means, said magnetic field generating means being spaced relative to each other in the direction of their relative alignment a distance sufficient to produce serial gaps between the magnetic fields generated such that magnetic articles attracted to said first belt means by one of the magnetic fields fall away from said first belt means at said gaps, and second belt means below said first belt means and supported at said gaps to receive magnetic articles falling from one of the magnetic fields and to transport said fallen magnetic articles to the next magnetic field where said magnetic articles are again attracted to said first belt means.

7. A magnetic refuse separator as set forth in claim 6 wherein said first belt means moves faster than said second belt means.

8. A magnetic refuse separator as set forth in claim 7 wherein the speed of said first belt means is at least 50 feet per minute greater than the speed of said second belt means.

9. A magnetic refuse separator as set forth in claim 8 wherein said first belt means moves at a speed of approximately 350 feet per minute, and wherein said second belt means moves at a speed of approximately 300 feet per minute.

10. A magnetic refuse separator comprising a first conveyor belt, means for moving said first belt along a first horizontal path, a stationary magnet supported adjacent and above said first belt along said first horizontal path to generate a stationary, attractive magnetic field through which said first belt moves, a second conveyor belt, means for moving said second belt along a second horizontal path, a second stationary magnet supported adjacent and above said second belt along said second horizontal path to generate a stationary, attractive magnetic field through which said second belt moves, said second magnet being spaced horizontally a predetermined distance from said first magnet in the direction of movement of said first belt along said first horizontal path to provide a gap in the magnetic field generated by said first and second magnets so that magnetic articles attracted to said first belt in the area of said first magnet are released in said gap and fall away from said first belt, a third conveyor belt, means supporting said third belt for movement along a third horizontal path below said first and second belts and with a portion of said third belt facing generally upwardly and being positioned generally between said first magnet and said second magnet so that articles released in said gap and falling away from said first belt fall into said third belt, and means for moving said third belt along said third horizontal path and into the attractive magnetic field generated by said second magnet so that magnetic articles falling from said first belt at said gap are conveyed by said third belt along said third horizontal path to the magnetic field of said second magnet and are attracted to said second belt in the area of said second magnet, whereby nonmagnetic articles carried with said magnetic articles are separated therefrom.

11. A magnetic refuse separator as set forth in claim 10 wherein said second belt moves along said second path faster than said third belt moves along said third path.

12. A magnetic refuse separator as set forth in claim 11 wherein the speed of said second belt is at least 50 feet per minute greater than the speed of said third belt.

13. A magnetic refuse separator as set forth in claim 12 wherein said second belt moves along said second path at a speed of approximately 350 feet per minute, and wherein said third belt moves along said third path at a speed of approximately 300 feet per minute.

14. A magnetic refuse separator comprising an endless conveyor belt having a generally horizontal lower extension movable along a first horizontal path, means for moving said conveyor belt so that said lower extension moves along said first horizontal path, first and second stationary magnets supported above said lower extension of said conveyor belt to generate a stationary attractive magnetic field through which said lower extension of said conveyor belt moves, said second magnet being spaced horizontally a predetermined distance from said first magnet in the direction of movement of said conveyor belt along said first horizontal path to provide a gap in the magnetic field generated by said magnets so that magnetic articles attracted to said conveyor belt in the area of said first magnet are released in said gap and fall away from said conveyor belt, and means for conveying articles along a second horizontal path located below said lower extension of said conveyor belt and generally between said magnets so that articles released in said gap and falling away from said conveyor belt fall onto said conveying means, move along said second horizontal path and into the attractive magnetic field generated by said second magnet, and are attracted to said conveyor belt in the area of said second magnet, whereby nonmagnetic articles carried with said magnetic articles are separated therefrom.

15. A magnetic refuse separator as set forth in claim 14 wherein said conveyor belt moves along said first path faster than said conveying means moves along said second path.

16. A magnetic refuse separator as set forth in claim 15 wherein the speed of said conveyor belt is at least 50 feet per minute greater than the speed of said conveying means.

17. A magnetic refuse separator as set forth in claim 16 wherein said conveyor belt moves along said first path at a speed of approximately 350 feet per minute, and wherein said conveying means moves along said second path at a speed of approximately 300 feet per minute.

18. A magnetic refuse separator comprising a plurality of relatively aligned, stationary magnetic field generating means, an endless conveyor belt associated with said magnetic field generating means and having a generally horizontal lower extension supported to move serially beneath said magnetic field generating means through the magnetic fields generated by said magnetic field generating means, said magnetic field generating means being spaced relative to each other in the direction of their relative alignment a distance sufficient to produce serial gaps between the magnetic fields generated such that magnetic articles attracted to said first belt means by one of the magnetic fields fall away from said first belt means at said gaps, and conveying means located below said conveyor belt and at said gaps for receiving magnetic articles falling from one of the magnetic fields and for transporting said fallen magnetic articles to the next magnetic field where said magnetic articles are again attracted to said conveyor belt.

19. A magnetic refuse separator as set forth in claim 18 wherein said conveyor belt moves faster than said conveying means moves.

20. A magnetic refuse separator as set forth in claim 19 wherein the speed of said conveyor belt is at least 50 feet per minute greater than the speed of said conveying means.

21. A magnetic refuse separator comprising a plurality of relatively aligned, magnetic field generating means, first belt means associated with said magnetic field generating means and supported to move serially beneath said magnetic field generating means through the magnetic fields generated by said magnetic field generating means, said magnetic field generating means being spaced relative to each other in the direction of their relative alignment a distance sufficient to produce serial gaps between the magnetic fields generated such that magnetic articles attracted to said first belt means by one of the magnetic fields fall away from said first belt means at said gaps, and second belt means below said first belt means and supported at said gaps for receiving magnetic articles falling from one of the magnetic fields and for transporting said fallen magnetic articles to the next magnetic field where said magnetic articles are again attracted to said first belt means, said second belt means moving more slowly than said first belt means.

22. A magnetic refuse separator as set forth in claim 21 wherein the speed of said first belt means is at least 50 feet per minute greater than the speed of second belt means.

23. A magnetic refuse separator as set forth in claim 22 wherein said first belt means moves at a speed of approximately 350 feet per minute, and wherein said second belt means moves at a speed of approximately 300 feet per minute.

* * * * *